US006741825B2

(12) United States Patent
Omata et al.

(10) Patent No.: US 6,741,825 B2
(45) Date of Patent: May 25, 2004

(54) IMAGE FORMING APPARATUS AND METHOD

(75) Inventors: Yasukuni Omata, Chigasaki (JP); Hideaki Mochimaru, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/962,681

(22) Filed: Sep. 26, 2001

(65) Prior Publication Data

US 2002/0044801 A1 Apr. 18, 2002

(30) Foreign Application Priority Data

Sep. 26, 2000 (JP) ..... P2000-292570
Sep. 6, 2001 (JP) ..... P2001-270235

(51) Int. Cl.[7] ..... G03G 15/00; G03G 15/16; G03G 15/20

(52) U.S. Cl. ..... 399/309; 399/66; 399/67; 399/308; 399/328; 399/329; 399/333; 430/124; 430/126

(58) Field of Search ..... 399/309, 307, 399/302, 308, 328, 329, 66, 67, 68, 75, 333; 430/124, 126

(56) References Cited

U.S. PATENT DOCUMENTS

| | | | | |
|---|---|---|---|---|
| 3,724,944 A | | 4/1973 | Sugita et al. | 355/18 |
| 3,765,760 A | | 10/1973 | Mochimaru | 355/58 |
| 3,884,576 A | | 5/1975 | Mochimaru et al. | 355/69 |
| 3,901,586 A | | 8/1975 | Suzuki et al. | 359/726 |
| 4,056,320 A | | 11/1977 | Mochimaru et al. | 355/75 |
| 4,105,326 A | | 8/1978 | Mochimaru | 355/55 |
| 4,535,982 A | | 8/1985 | Mochimaru | 271/127 |
| 4,605,299 A | | 8/1986 | Mochimaru | 399/111 |
| 4,703,334 A | | 10/1987 | Mochimaru et al. | 347/130 |
| 4,753,543 A | | 6/1988 | Mochimaru et al. | 400/703 |
| 4,757,344 A | | 7/1988 | Idenawa et al. | 399/113 |
| 4,875,063 A | | 10/1989 | Idenawa et al. | 347/152 |
| 4,987,446 A | | 1/1991 | Mochimaru et al. | 399/113 |
| 5,089,855 A | | 2/1992 | Mochimaru et al. | 399/297 |
| 5,293,537 A | | 3/1994 | Carrish | 399/329 |
| 5,615,872 A | | 4/1997 | Mochimaru | 271/3.14 |
| 5,875,372 A | * | 2/1999 | Sato et al. | 399/67 |
| 5,991,563 A | * | 11/1999 | Haneda et al. | 399/309 |
| 6,151,057 A | | 11/2000 | Yamazaki et al. | 347/248 |

FOREIGN PATENT DOCUMENTS

| | | | |
|---|---|---|---|
| EP | 0 821 289 A1 | | 1/1998 |
| JP | 1-209470 | | 8/1989 |
| JP | 02-248977 | * | 10/1990 |
| JP | 10-207247 | | 8/1998 |
| JP | 10-274894 | | 10/1998 |
| JP | 11-102134 | | 4/1999 |
| JP | 11-327335 | | 11/1999 |
| JP | 2000-105513 | * | 4/2000 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus which may form first and second visual images on first and second sides of a recording medium, includes a first image bearing member, a second image bearing member, a first transfer device that transfers the first visual image formed on the first image bearing member onto the second image bearing member or the second visual image formed on the first image bearing member onto the second side of the recording medium, a second transfer device that transfers the first visual image carried by the second image bearing member onto the first side of the recording medium, and a fixing device including first and second fixing members so as to fix the second and first visual images on the second and first sides of the recording medium, respectively. Surface properties of the first fixing member and the second image bearing member are substantially the same.

32 Claims, 6 Drawing Sheets

IMAGE FORMING APPARATUS AND METHOD

BACKGROUND OF THE INVENTION

1. Field of the Invention

The present invention relates to an image forming apparatus and method of forming images on both sides of a recording medium.

2. Discussion of the Background

Image forming apparatuses, such as printers, copying machines, facsimile machines, etc. which form images on both sides of a recording medium (hereinafter may be referred to as a sheet) are known.

Such image forming apparatuses capable of forming images on both sides of a sheet generally transfer an image of one side of an original, which has been formed and visualized on an image bearing member, onto one side of a sheet, and then fix the image onto the sheet by a fixing device. The sheet is then reversed by a reversing path, etc., and is conveyed again so that an image of the other side of the original, which has been also formed and visualized on the image bearing member, is transferred and fixed onto the other side of the sheet.

In the above image forming apparatuses, because a sheet conveying direction has to be reversed, and a sheet tends to be curled when an image is fixed onto one side of the sheet, reliability of sheets conveyance is hard to be obtained.

Japanese Laid-open Patent Publications No. 1-209470 and No. 11-327335 respectively describe an image forming apparatus in which toner images, which have been transferred onto both sides of a sheet from a first image bearing member and a second image bearing member, are fixed at one time.

Japanese Laid-open Patent Publication No. 1-209470 describes an image forming apparatus that transfers a first image formed on a photoreceptor onto a transfer belt by a first transfer device and then transfers a second image formed on the photoreceptor onto one side of a sheet by the first transfer device. Thereafter, the image forming apparatus transfers the first image on the transfer belt onto the other side of the sheet by a second transfer device, thus transferring the images on both sides of the sheet. The sheet is then conveyed to a fixing device, where the images are fixed onto both sides of the sheet.

Japanese Laid-open Patent Publication No. 11-327335 describes another image forming apparatus that includes two transfer devices. After transferring multi-color images onto both sides of a sheet, the sheet is conveyed to a fixing device, and the images are fixed onto both sides of the sheet at one time by the fixing device. The image forming apparatus further includes a spur having plural protrusions on its circumferential surface so as to guide conveyance of a sheet having unfixed multi-color images on both sides thereof.

SUMMARY OF THE INVENTION

According to one aspect of the present invention, an image forming apparatus which may form first and second visual images on first and second sides of a recording medium, includes a first image bearing member configured to bear the first and second visual images, a second image bearing member configured to bear the first visual image transferred from the first image bearing member, a first transfer device configured to transfer the first visual image formed on the first image bearing member onto the second image bearing member or the second visual image formed on the first image bearing member onto the second side of the recording medium, a second transfer device configured to transfer the first visual image carried by the second image bearing member onto the first side of the recording medium, and a fixing device configured to fix the first and second visual images transferred onto the recording medium. The fixing device includes first and second fixing members so as to fix the second and first visual images on the second and first sides of the recording medium, respectively. The first fixing member and the second image bearing member contact the second and first sides of the recording medium, respectively, and surface properties of the first fixing member and the second image bearing member are substantially the same.

According to another aspect of the present invention, an image forming apparatus which may form first and second visual images on first and second sides of a recording medium, includes a first image bearing member configured to bear the first and second visual images, a second image bearing member configured to bear the first visual image transferred from the first image bearing member, a first transfer device configured to transfer the first visual image formed on the first image bearing member onto the second image bearing member or the second visual image formed on the first image bearing member onto the second side of the recording medium, a second transfer device configured to transfer the first visual image carried by the second image bearing member onto the first side of the recording medium, and a fixing device configured to fix the first and second visual images transferred onto the recording medium. The fixing device includes first and second fixing members so as to fix the second and first visual images on the second and first sides of the recording medium, respectively. The first and second fixing members contact the second and first sides of the recording medium, respectively, and surface properties of the first and second fixing members are substantially the same.

According to still another aspect of the present invention, a method of forming an image, includes transferring a first visual image formed on a first image bearing member onto a second image bearing member, transferring a second visual image formed on the first image bearing member onto a second side of a recording medium, transferring the first visual image from the second image bearing member onto a first side of the recording medium, bringing a first fixing member and the second image bearing member into contact with the second and first sides of the recording medium, respectively, and fixing the first and second visual images on the first and second sides of the recording medium in a state that surface properties of the first fixing member and the second image bearing member are substantially the same.

According to still another aspect of the present invention, a method of forming an image, includes transferring a first visual image formed on a first image bearing member onto a second image bearing member, transferring a second visual image formed on the first image bearing member onto a second side of a recording medium, transferring the first visual image from the second image bearing member onto a first side of the recording medium, bringing first and second fixing members into contact with the second and first sides of the recording medium, respectively, and fixing the first and second visual images on the first and second sides of the recording medium in a state that surface properties of the first and second fixing members are substantially the same.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
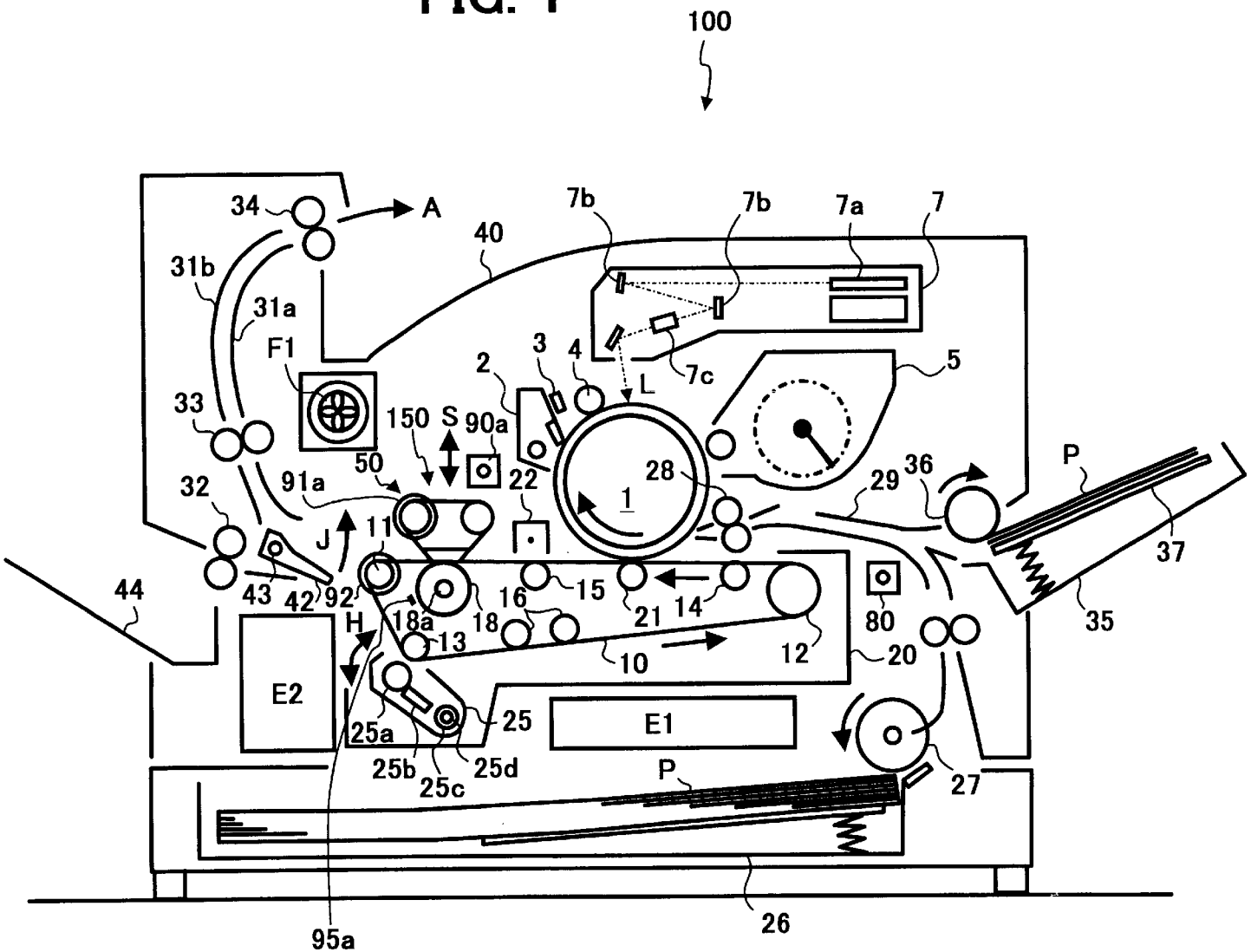
FIG. 1 is a cross sectional view of a printer as an example of an image forming apparatus according to an embodiment of the present invention.

Preferred embodiments of the present invention are described in detail referring to the drawings, wherein like reference numerals designate identical or corresponding parts throughout the several views.

FIG. 1 is a cross sectional view of a printer as an example of an image forming apparatus according to an embodiment of the present invention.

Referring to FIG. 1, a printer 100 includes a drum-shaped photoreceptor 1 serving as a first image bearing member at a substantially central part of the printer 100. Arranged around the photoreceptor 1 are a cleaning device 2, a discharging device 3, a charging device 4, and a developing device 5. An exposing device 7 is arranged above the photoreceptor 1. Laser light (L) emitted by the exposing device 7 irradiates the photoreceptor 1 at a writing position between the charging device 4 and the developing device 5.

In this embodiment, the photoreceptor 1, the cleaning device 2, the discharging device 3, the charging device 4, and the developing device 5 are integrally assembled in a process cartridge. The process cartridge can be replaced with a new one when its useful lifetime ends.

A belt unit 20 is arranged below the photoreceptor 1. The belt unit 20 includes as the main component thereof an intermediate transfer belt 10 serving as a second image bearing member. The photoreceptor 1 is arranged so that a part thereof contacts the intermediate transfer belt 10.

The intermediate transfer belt 10 is spanned around and supported by rollers 11, 12, and 13, so as to be rotatable in a counter-clockwise direction in FIG. 1. In the embodiment, the roller 11 functions as a drive roller. The intermediate transfer belt 10 is heat-resisting and has a resistance value that enables transfer of toner.

Arranged inside of a loop of the intermediate transfer belt 10 are rear-side supporting rollers 14 and 15, a cooling device 16, a fixing roller 18, and a first transfer device 21. The fixing roller 18 includes a heat source such as a heater (18*a*) inside thereof. The first transfer device 21 is arranged opposite to the photoreceptor 1 via the intermediate transfer belt 10. The first transfer device 21 transfers a toner image formed on the photoreceptor 1 onto the intermediate transfer belt 10 or onto a sheet surface opposing the photoreceptor 1.

Arranged around the outer circumference of the intermediate transfer belt 10 are a second transfer device 22, a fixing unit 50, and a belt cleaning device 25. The fixing unit 50 and the fixing roller 18 make up a fixing device 150. Although a construction of the fixing unit 50 will be described in detail later, a fixing belt 51 shaped in a form of an endless heat-resisting film is spanned around a drive roller 52, a driven roller 53, and a heating unit 54. The fixing unit 50 is configured to move up and down in a direction indicated by arrow (S) by a device (not shown), so as to be pressed against the fixing roller 18 via the intermediate transfer belt 10 and a sheet, and to be separated from the fixing roller 18. A fan (F1) is arranged at a left upper side of the fixing unit 50 for discharging inside air so as to prevent inside temperature from rising.

The belt cleaning device 25 for the intermediate transfer belt 10 includes a cleaning roller (25*a*), a blade (25*b*), and a toner conveying device (25*c*). The belt cleaning device 25 removes unnecessary toner remaining on a surface of the intermediate transfer belt 10. Toner deposited in the cleaning device 25 is conveyed to a toner collecting container (not shown) by the toner conveying device (25*c*). The cleaning device 25 is rotatable in a direction indicated by arrow (H) around a rotational fulcrum (25*d*). The cleaning device 25 is rotated by a device (not shown) so that the cleaning roller (25*a*) is brought into contact with or separated from the intermediate transfer belt 10.

A sheet feeding cassette 26 is arranged at a bottom part of the main body of the printer 100. The sheet feeding cassette 26 is constructed to be drawn out rightward in FIG. 1. The sheet feeding cassette 26 accommodates transfer sheets (P) as recording media. A sheet feeding roller 27 is arranged above a tip end side (at a right side as viewed in FIG. 1) of the sheet feeding cassette 26 in a sheet feeding direction.

Further, a pair of registration rollers 28 are arranged at the right side of the photoreceptor 1. Moreover, a sheet guide member 29 is arranged at the right side of the registration rollers 28 so as to guide a sheet (P) from the registration rollers 28 to a transfer position. An electric unit (El) and a control unit (E2) are arranged above the sheet feeding cassette 26.

Further, a manual sheet feeding device 35 is arranged at a right side plate of the main body of the printer 100, and a sheet feeding roller 36 feeds out sheets P set on a sheet setting table 37. A sheet (P) fed from the manual sheet feeding device 35 is guided by the sheet guide member 29 to the registration rollers 28.

A switching claw 42 is provided at the left side of the fixing unit 50. The switching claw 42 is swingable around a fulcrum 43, so as to switch a sheet conveying direction of a sheet (P) conveyed from the belt unit 20 to a sheet discharging/stacking part 40 provided at an upper surface of the main body or to a sheet discharging tray 44 provided at a side plate of the main body. The switching claw 42 is operated by an actuator (not shown), for example, a solenoid, etc. When the switching claw 42 is positioned as illustrated in FIG. 1, the sheet (P) is conveyed to the sheet discharging/stacking part 40, and when the switching claw 42 is switched to a direction indicated by arrow (J), the sheet (P) is conveyed to the sheet discharging tray 44.

A pair of sheet conveying rollers 33 are arranged above the switching claw 42 to convey the sheet (P). Further, a pair of sheet discharging rollers 34 are arranged above the sheet conveying rollers 33 to discharge the sheet (P) to the sheet discharging/stacking part 40. Guide members 31*a* and 31*b* are arranged between the sheet conveying rollers 33 and the sheet discharging rollers 34. Another pair of sheet discharging rollers 32 are arranged left of the switching claw 42 to discharge the sheet (P) to the sheet discharging tray 44.

Figure 2:
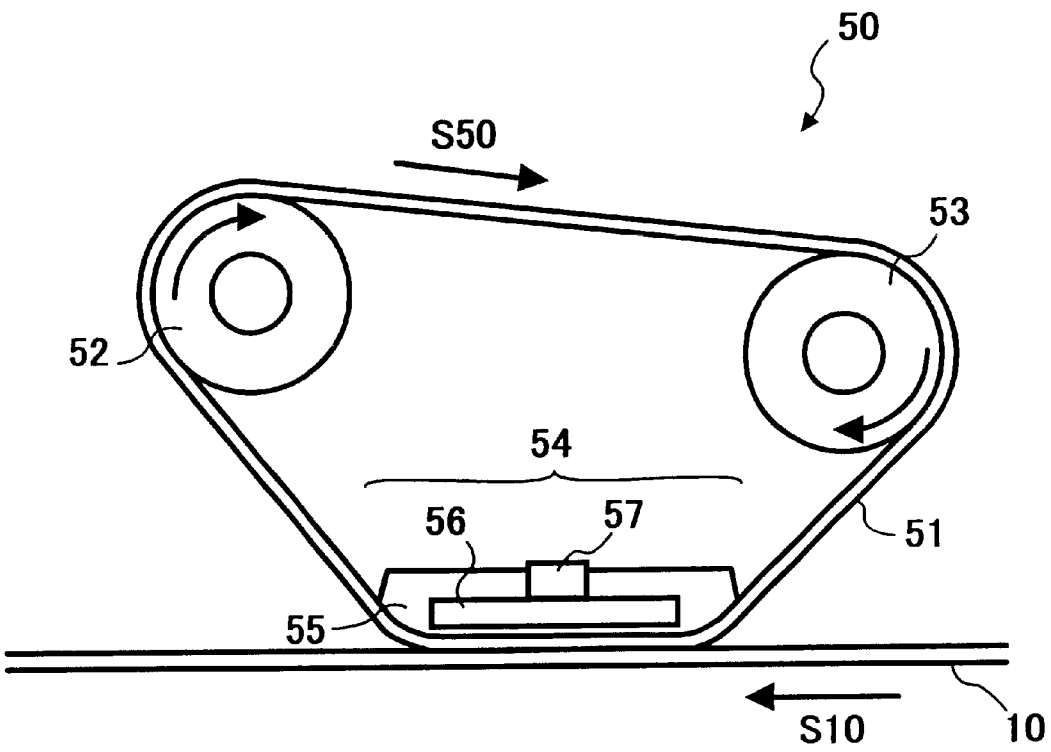
FIG. 2 is a detailed view of a construction of a fixing device of the printer illustrated in FIG. 1.

FIG. 2 is a detail view of a construction of the fixing unit 50. As illustrated in FIG. 2, in the fixing unit 50, a fixing belt 51 is spanned around the drive roller 52, the driven roller 53, and the heating unit 54. The fixing unit 50 fixes toner images on both sides of the sheet (P) in cooperation with the fixing roller 18 arranged inside of the loop of the intermediate transfer belt 10. The drive roller 52 is rotatably driven in a clockwise direction in FIG. 2, thereby rotating the fixing belt 51 in a direction indicated by arrow (S50). The driven roller 53 also serves as a tension roller that always applies tension to the fixing belt 51.

A sheet (P) having an unfixed toner image on one or both sides thereof is conveyed in a direction indicated by arrow (S10) in close contact with the intermediate transfer belt 10, and passes through a fixing nip part formed between the fixing roller 18/intermediate transfer belt 10 and the fixing unit 50 moved down for a fixing operation.

In this embodiment, the fixing unit 50 is press-contacted against the fixing roller 18 via the intermediate transfer belt 10, and the sheet (P) passes between the fixing belt 51 and the intermediate transfer belt 10. Thus, the fixing belt 51 and the intermediate transfer belt 10 contact respective surfaces of the sheet (P) at a time of fixing a toner image thereon.

The fixing belt 51 preferably has a high heat-resisting property, a high toner releasing property, and high durability. The fixing belt 51 according to the embodiment of the present invention has belt thickness of, for example, 200 $\mu$m or less.

Specifically, the fixing belt 51 is formed from a single-layer film or a multilayer film made of heat-resistant resin, such as polyimide, polyetherimide, polyether sulphide (PES), tetrafluoroethylene-perfluoroalkyl vinyl ether copolymers (PFA), etc. For example, the fixing belt 51 of 20 $\mu$m in thickness includes a coat layer of 10 $\mu$m in thickness having a toner releasing property made of fluororesin, such as polytetrafluoroethylene (PTFE), tetrafluoroethylene-perfluoroalkyl vinyl ether copolymers (PFA), etc, to which electrically conductive material is added, at an image contact surface side (i.e., at an outer circumferential surface side). In addition, the fixing belt 51 includes an elastic layer made of fluororubber, silicone rubber, etc. at an inner circumferential surface side.

In the heating unit 54, a heating element (i.e., a fixing heater) 56 is supported by a flat substrate 55. The substrate 55 is made of material having high thermal conductivity and high electric resistance such as alumina, etc. The fixing heater 56 constructed of a resistant heating element is provided longitudinally (i.e., in a widthwise direction of the fixing belt 51) with the surface of the substrate 55 in contact with the fixing belt 51. The fixing heater 56 is coated with electrically resistant material such as silver palladium (Ag/Pd), etc. in a form of a line or stripe by a screen printing method, etc.

Further, electrodes (not shown) are formed at both end portions of the fixing heater 56. The resistant heating element of the fixing heater 56 is heated by feeding current between the electrodes. In addition, a fixing temperature sensor 57 constructed of a thermistor is provided on another surface of the substrate 55 opposite to the surface provided with the fixing heater 56.

Figure 7:
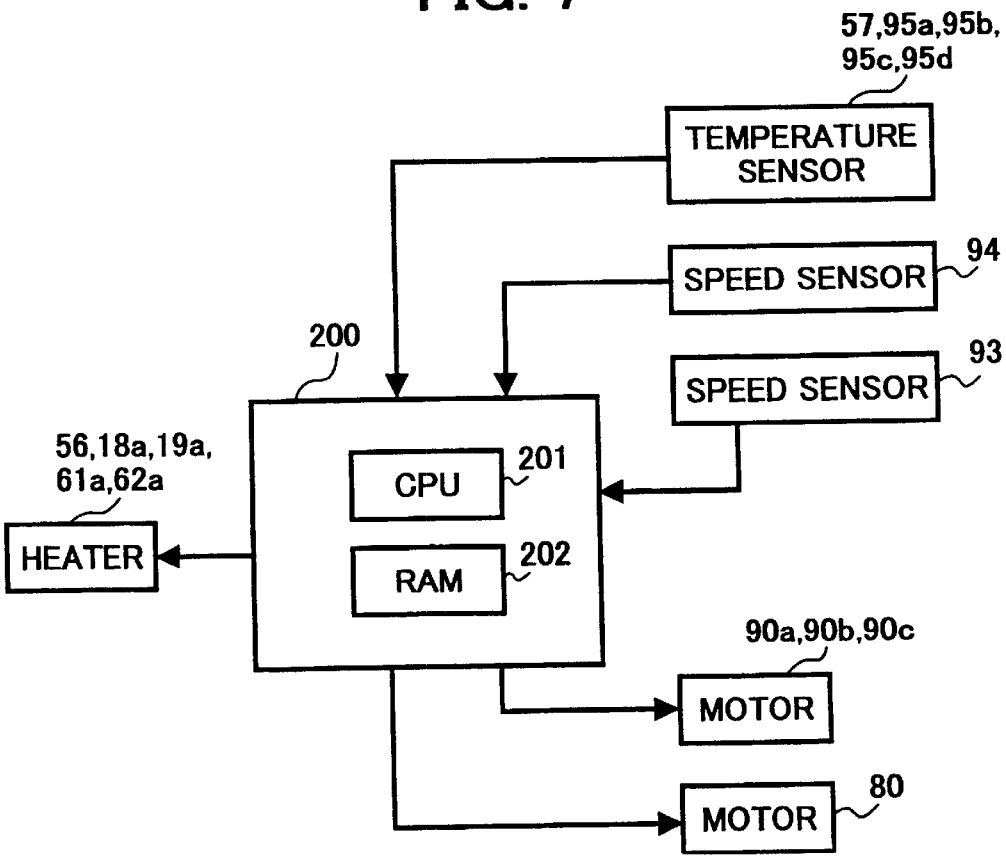
FIG. 7 is a block diagram of a control device of the printers illustrated in FIGS. 1, 3, and 5 according to the embodiments of the present invention.

Temperature information of the substrate 55 detected by the fixing temperature sensor 57 is transmitted to a control device 200 illustrated in FIG. 7. As illustrated in FIG. 7, the control device 200 includes a CPU (central processing unit) 201 and RAM (random-access memory) 202. The control device 200 controls an electric amount to be supplied to the fixing heater 56, thereby controlling the heating unit 54 at a predetermined temperature.

In this embodiment, the intermediate transfer belt 10 serving as a second image bearing member is formed from material of the s kind as that of the fixing belt 51. As a result, surface properties of the intermediate transfer belt 10 and the fixing belt 51, which contact respective surfaces of a sheet (P) at a time of fixing a toner image thereon, are substantially the same.

In the printer 100 according to the embodiment of the present invention, a sheet (P) having unfixed toner images on front and rear surfaces thereof is passed between the intermediate transfer belt 10 and the fixing belt 51 while being held on the intermediate transfer belt 10, and the toner images are fixed onto both sides of the sheet (P) in cooperation with the fixing roller 18 and the fixing unit 50. At this time, because surface properties of the intermediate transfer belt 10 and the fixing belt 51 are substantially the same, image quality on both sides of the sheet (P) results in being substantially equal.

Surface roughness of the fixing belt 51 and the intermediate transfer belt 10 in direct contact with a sheet (P) affects gloss of images fixed on the sheet (P). Therefore, making surface properties (e.g., surface roughness in this embodiment) of the intermediate transfer belt 10 and the fixing belt 51 in contact with respective surfaces of the sheet (P) substantially the same allows image quality on both sides of the sheet (P) to be substantially equal.

Although surface properties of the intermediate transfer belt 10 and the fixing belt 51 are substantially the same by forming the intermediate transfer belt 10 and the fixing belt 51 from material of the same kind in this embodiment, the intermediate transfer belt 10 and the fixing belt 51 may be formed from the same material.

Specifically, for example, when the intermediate transfer belt 10 is formed from a polyimide resin film, and when the fixing belt 51 is formed from a polyetherimide resin film, i.e., when the intermediate transfer belt 10 and the fixing belt 51 are formed from material of the same kind, surface properties of the intermediate transfer belt 10 and the fixing belt 51 in contact with respective surfaces of a sheet (P) are substantially the same.

When the intermediate transfer belt 10 and the fixing belt 51 are formed from the same material, such as, for example, a polyimide resin film, surface properties of the intermediate transfer belt 10 and the fixing belt 51 in contact with respective surfaces of a sheet (P) are also substantially the same.

Even if the intermediate transfer belt 10 and the fixing belt 51 are not formed from material of the same kind or the same material, similar effects can be obtained by providing the same coat layers (e.g., toner releasing layers made of fluorine resin, such as PTFE, PFA, etc.) on respective surfaces of the intermediate transfer belt 10 and the fixing belt 51. With provision of such coat layers, surface properties of the intermediate transfer belt 10 and the fixing belt 51 result in being substantially the same.

According to the embodiment of the present invention, excessive gloss and roughness of an image fixed on a sheet (P) are prevented by setting surface roughness (Rz) of the intermediate transfer belt 10 and the fixing belt 51 to 100 $\mu$m or less. "Rz" is a ten-point mean surface roughness scale, which is prescribed in JIS (Japanese Industrial Standards).

In this embodiment, the fixing device 150 of a fixing belt type is employed. Because a fixing pin part of the belt type fixing device is greater than that of a fixing device of a fixing roller type, the belt type fixing device is superior in fixing performance. Further, as the fixing belt 51 having a thickness of 200 $\mu$m or less is employed in this embodiment, the fixing belt 51 can be prepared for a fixing operation in a short heating-up time. Moreover, because the fixing belt 51 is formed from a heat-resisting resin film, the belt type fixing device can be low cost.

Further, in this embodiment, a motor (90*a*) that drives the drive roller 52 so as to rotate the fixing belt 51 and a motor 80 that drives the drive roller 11 so as to rotate the intermediate transfer belt 10 are individually provided. The control device 200 illustrated in FIG. 7 controls the motors (90*a*) and 80 so that the linear velocities of the fixing belt 51 and the intermediate transfer belt 10 are substantially the same.

When the fixing belt 51 and the intermediate transfer belt 10 are rotatably driven by the same motor, differences between the linear velocities of the fixing belt 51 and the intermediate transfer belt 10 may occur according to the accuracy of parts such as gears which transmit a driving force of the motor to the drive rollers 52 and 11, or accuracy in assembling parts, etc. The difference between the linear velocities of the fixing belt 51 and the intermediate transfer belt 10 results in image blurring. In order to avoid the image blurring, the linear velocities of the fixing belt 51 and the intermediate transfer belt 10 are controlled to be substantially the same by using the individual motors (90*a*) and 80. Thereby, deterioration of image quality is obviated.

Further, as a result of using the individual motors (90*a*) and 80, a construction of a driving system can be simple and a space for the driving system can be saved as compared to a case in which the fixing belt 51 and the intermediate transfer belt 10 are rotatably driven by the same motor via gear trains.

As one example of controlling linear velocities of the fixing belt 51 and the intermediate transfer belt 10 to be substantially the same, the control device 200 illustrated in FIG. 7 controls respective numbers of revolutions of the motors (90*a*) and 80 by use of encoders (91*a*) and 92, respectively.

Figure 6A:
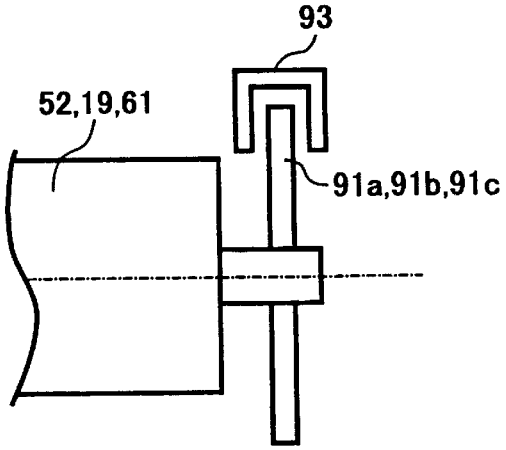
FIG. 6A is a schematic view of an encoder, an optical speed sensor, and a drive or fixing roller in the printers illustrated in FIGS. 1, 3, and 5 according to the embodiments of the present invention.
Figure 6B:
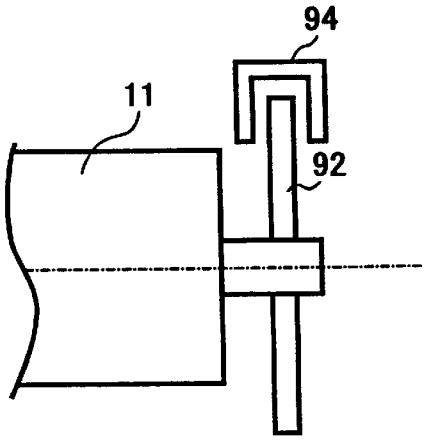
FIG. 6B is a schematic view of an encoder, an optical speed sensor, and a drive roller for an intermediate transfer belt in the printers illustrated in FIGS. 1, 3, and 5 according to the embodiments of the present invention.

Specifically, as illustrated in FIGS. 1, 6A, and 6B, the encoders (91*a*) and 92 of rotation slit disks having slits on the circumferential surface thereof are provided on respective rotation output shafts of one of the rollers around which the fixing belt 51 and the intermediate transfer belt 10 are spanned, respectively. In this embodiment, the encoders (91*a*) and 92 are provided on the respective rotation output shafts of the drive rollers 52 and 11, respectively. The respective numbers of revolutions of the drive rollers 52 and 11 are detected by the method of detecting the slits on the circumferential surface of the rotation slit disks of the encoders (91*a*) and 92 with optical speed sensors 93 and 94, respectively.

The control device 200 controls the respective numbers of revolutions of the motors (90*a*) and 80 based on detection outputs of the optical speed sensors 93 and 94, respectively. With the use of the encoders (91*a*) and 92 and the optical speed sensors 93 and 94 functioning as a detecting device, the linear velocities of the fixing belt 51 and the intermediate transfer belt 10 can be controlled with accuracy.

In this embodiment, the control device 200 further controls respective temperatures of the fixing heater 56 of the fixing unit 50 and the heater (18*a*) of the fixing roller 18 arranged opposite to each other via the intermediate transfer belt 10. The respective temperatures of the fixing heater 56 and heater (18*a*) are detected by temperature sensors 57 and (95*a*), respectively. The control device 200 individually controls supply of electricity to the fixing heater 56 and heater (18*a*) based on detection outputs of the temperature sensors 57 and (95*a*), respectively.

In particular, for example, when both side recording in which toner images are transferred onto both sides of a sheet (P) is selected, because the energy required for fixing the images is larger than when one side recording in which a toner image is transferred onto one side of the sheet (P) is selected, the printer 100 is controlled to increase the input voltage to the heat sources (i.e., the fixing heater 56 and heater 18*a*) or increase the frequency of inputting the voltage into the heat sources.

Further, when fixing an image formed on one side of a sheet (P), the control device 200 controls to decrease or stop the supply of electricity to the heater 18(*a*) arranged inside of the loop of the intermediate transfer belt 10.

By individually controlling the respective temperatures of the fixing heater 56 of the fixing unit 50 arranged outside of the loop of the intermediate transfer belt 10 and the heater (18*a*) of the fixing roller 18 arranged inside of the loop, toner images are surely fixed on both sides of the sheet (P) at the time of both side recording, and an excessive heat amount at the time of one side recording is avoided. As a result, an adequate fixing operation can be performed without wasting energy.

Next, an image forming operation in the printer 100 thus constructed is described.

First, an operation for obtaining images on both sides of a sheet (P) is described. In the description of obtaining images on both sides of a sheet (P), an image which is first formed will be referred to as a first side image, and an image which is later formed will be referred to as a second side image. Further, a sheet side onto which the first side image is transferred will be referred to as a first sheet side, and a sheet side onto which the second side image is transferred will be referred to as a second sheet side.

As described above, the image forming apparatus of the embodiment is a printer, in which a signal for writing an image is sent from a host computer (not shown). In accordance with a received image signal, the exposing device 7 is driven. The laser light (L) emitted from a laser light source (not shown) is deflected so as to scan by a polygonal mirror (7*a*) which is rotated by being driven by a motor (not shown). The laser light (L) is irradiated onto the photoreceptor 1 which has been uniformly charged by the charging device 4 via mirrors (7*b*), and a fθ lens (7*c*), etc., so that an electrostatic latent image corresponding to writing information is formed on the photoreceptor 1.

The latent image on the photoreceptor 1 is developed with toner by the developing device 5, thereby a visual image (i.e., a toner image) is formed and carried on the surface of the photoreceptor 1 as a first side image. The first side toner image on the photoreceptor 1 is transferred by the first transfer device 21 (i.e., a transfer roller), which is provided at a rear side of the intermediate transfer belt 10 serving as a second image bearing member, onto a surface of the intermediate transfer belt 10 which is being moved in synchronization with the rotations of the photoreceptor 1.

Residual toner on the surface of the photoreceptor 1 is removed by the cleaning device 2. Subsequently, the surface of the photoreceptor 1 is uniformly discharged by the discharging device 3 to be prepared for a next image forming operation.

The intermediate transfer belt 10 carries the first side toner image transferred thereupon and is driven in a counterclockwise direction in FIG. 1. At this time, so that the toner image on the intermediate transfer belt 10 is not disturbed, the second transfer device 22 (i.e., a transfer charger), the fixing unit 50, and the cleaning device 25 are controlled to be held in a non-operating condition, respectively. Specifically, each power input thereto is cut off or the second transfer device 22, the fixing unit 50, and the cleaning device 25 are controlled to be separated from the intermediate transfer belt 10.

When the intermediate transfer belt 10 is conveyed so that the toner image thereupon is moved to a predetermined position, a second side image starts to be formed on the photoreceptor 1 by the above-described image forming process, and sheet feeding starts.

When the sheet feeding rollers 27 or 36 is rotated in the arrow direction, an uppermost sheet (P) in the sheet feeding cassette 26 or the manual sheet feeding tray 35 is fed out therefrom to be conveyed to the pair of registration rollers 28.

The intermediate transfer belt 10 is moved in synchronization with the rotations of the photoreceptor 1, so that the first side image transferred onto the intermediate transfer belt 10 is moved one cycle to be conveyed to a position where the intermediate transfer belt 10 and the photoreceptor 1 contact each other.

The second side image formed on the photoreceptor 1 is first transferred by the first transfer device 21 onto a second side of the sheet (P) which has been conveyed into between the intermediate transfer belt 10 and the photoreceptor 1 through the paired registration rollers 28. The sheet (P) is conveyed by the paired registration rollers 28 at an appropriate timing such that the sheet (P) and the second side image on the photoreceptor 1 are correctly aligned. The sheet (P) and the first side image on the intermediate transfer belt 10 are also aligned.

While the second side image on the photoreceptor 1 is transferred onto the second side of the sheet (P), the other side (first side) of the sheet (P) is in close contact with, and is moved together with the first side image on the intermediate transfer belt 10. When the sheet (P) passes an acting area of the second transfer device 22, a voltage is applied to the second transfer device 22 and thereby the first side image on the intermediate transfer belt 10 is transferred onto the sheet (P).

The sheet (P) onto which the toner images have been transferred on both sides thereof by the actions of the first and second transfer devices 21 and 22 is conveyed to a fixing area of the fixing device 150 as the intermediate transfer belt 10 is rotated. At the fixing area, the fixing unit 50 is moved downward so that the heating unit 54 is press-contacted against the fixing roller 18 via the intermediate transfer belt 10. Thereby, the toner images on both sides of the sheet (P) are fixed at one time by cooperative work of the fixing unit 50 and the fixing roller 18.

After transfer of the toner images onto both sides of the sheet (P), the sheet (P) is conveyed without being separated from the intermediate transfer belt 10 in a state that the sheet (P) and the intermediate transfer belt 10 are overlapped with each other, and the toner images are fixed onto the sheet (P) in such a state. Therefore, the toner images are not disturbed and thereby image blurring is prevented.

Further, as described above, because the surface properties of the fixing belt 51 and the intermediate transfer belt 10 are substantially the same, the image quality on both sides of the sheet (P) can be substantially equal.

The sheet (P) after passing the fixing area is separated from the intermediate transfer belt 10 at a sheet separation part at the drive roller 11 by curvature of the intermediate transfer belt 10, and its conveyance direction is switched by the switching claw 42. Then, the sheet (P) is discharged to the sheet discharging/stacking part 40 or to the sheet discharging tray 44.

When a sheet (P) is discharged to the sheet discharging/stacking part 40 provided at an upper surface of the main body, the sheet (P) is discharged to the sheet discharging/stacking part 40 with the second side of the sheet (P), on which an image to be later formed, i.e., an image which is directly transferred from the photoreceptor 1 to the sheet (P), faced down. Therefore, in order to stack sheets (P) carrying images on both sides thereof in a correct order of pages on the sheet discharging/stacking part 40, an image of the second page of an original must be first formed so as to be transferred onto the intermediate transfer belt 10, and thereafter, an image of the first page of the original is formed so as to be directly transferred from the photoreceptor 1 onto the sheet (P). Accordingly, in order to stack sheets (P) carrying images on both sides thereof in a correct order of pages on the sheet discharging/stacking part 40, the first side image must be an image of the second page of an original and the second side image must be an image of the first page of the original.

Namely, when an image exists on an even-numbered page of an original, the image on the even-numbered page is first formed so as to be transferred onto the intermediate transfer belt 10, and thereafter an image on the preceding odd-numbered page is formed so as to be directly transferred from the photoreceptor 1 onto the sheet (P). In this case, images are formed in the order of second page, first page, fourth page, third page, sixth page, fifth page, and so on.

When a sheet (P) is discharged to the sheet discharging tray 44 provided at a side plate of the main body, the sheet (P) is discharged to the sheet discharging tray 44 with the second side of the sheet (P), on which an image to be later formed, i.e., an image which is directly transferred from the photoreceptor 1 to the sheet (P), faced up. Therefore, in order to stack sheets (P) carrying images on both sides thereof in a correct order of pages on the sheet discharging tray 44, the first side image must be an image of the first page of an original and the second side image must be an image of the second page of the original.

When an image exists on an odd-numbered page of an original, the image on the odd-numbered page is first formed so as to be transferred onto the intermediate transfer belt 10, and thereafter an image on the preceding even-numbered page is formed so as to be directly transferred from the photoreceptor 1 onto the sheet (P). In this case, images are formed in the order of first page, second page, third page, fourth page, fifth page, sixth page, and so on.

In this embodiment, a user can designate whether to discharge the sheet (P) to the sheet discharging/stacking part 40 or to the sheet discharging tray 44 by an operation of an operation panel (not shown) or a host computer (not shown).

That is, the user can designate any one of plural sheet discharging sections to discharge the sheet (P) thereto.

When any one of the sheet discharging sections is designated, a control device (not shown) of the printer 100 automatically controls the order of image formation so that the sheet (P) is discharged to the designated sheet discharging section in a correct order of pages.

Thus, a user can obtain a sheet (P) having images on both sides thereof in a correct order of pages on any one of the sheet discharging sections by a simple operation without worrying about order of image formation. The above-described change of order of image formation for obtaining correctly arranged pages can be realized by a known technology to store image data in a memory.

In this embodiment, when a sheet (P) is fed from the manual sheet feeding device 35 and is discharged to the sheet discharging tray 44, a sheet conveying path from a sheet feeding section to a sheet discharging section is substantially linear. In a case of recording an image on a sheet having rigidity, such as a thick paper, and an overhead transparency film, such kind of recording media having images on one or both sides thereof can be smoothly discharged in a correct order of pages by using the manual sheet feeding device 35 and designating the sheet discharging tray 44.

When an ordinary sheet is used, the sheet can be fed from either the sheet feeding cassette 26 or the manual sheet feeding device 35 and can be discharged to either the sheet discharging/stacking part 40 or the sheet discharging tray 44. Also in this case, sheets having images on one or both sides thereof can be discharged in a correct order of pages. With respect to the most frequently used sheets, an operation in which the sheet is fed from the sheet feeding cassette 26 and is discharged to the sheet discharging/stacking part 40 may be set as a default condition.

When a mirrow image is formed on the photoreceptor 1 and the image is directly transferred onto a sheet (P), the image is obtained as a correct image on the sheet (P). When an image formed on the photoreceptor 1 is once transferred onto the intermediate transfer belt 10 and is then transferred onto a sheet (P), if the image is formed on the photoreceptor 1 as a mirror image, the image is obtained on the sheet (P) as the mirror image. Therefore, in the embodiment, the exposure is performed such that the first side image, which is transferred from the intermediate transfer belt 10 to a sheet (P), is formed on the photoreceptor 1 as a correct image, and the second side image, which is directly transferred from the photoreceptor 1 onto the sheet (P), is formed as a mirror image on the photoreceptor 1.

Exposure switching between correct image and mirror image formations can be also realized by a known image processing technology.

The cleaning device 25 separated from the intermediate transfer belt 10 is rotated, after an image is transferred from the intermediate transfer belt 10 to a sheet (P), such that the cleaning roller (25*a*) of the cleaning device 25 contacts the intermediate transfer belt 10. Residual toner on the intermediate transfer belt 10 is moved onto the cleaning roller (25*a*) and then scraped off the cleaning roller (25*a*) by the blade (25*b*). The scraped off toner is then collected by the toner conveying device (25*c*) to be conveyed to a toner collecting container (not shown). The above-described residual toner, which has been heated by the fixing roller 18 and the fixing unit 50, is easy to be moved to the cleaning roller (25*a*) before the residual toner is cooled. Therefore, the above cleaning is preferably performed upstream of the cooling devices 16.

The intermediate transfer belt 10 passed the cleaning area of the cleaning device 25 is cooled by the operation of the cooling devices 16. The cooling devices 16 may use various heat radiating systems. For example, when an air circulating system is used, air is preferably circulated after toner images on the intermediate transfer belt 10 are transferred onto a sheet (P) so that the toner images on the intermediate transfer belt 10 are not disturbed by the air. Also, a cooling system using a heat pipe can be used, in which the heat pipe directly contacts the internal surface of a loop of the intermediate transfer belt 10 to absorb heat therefrom.

Next, an operation of the printer 100 when obtaining an image on one side of a sheet (P) is described.

First, an operation for one side recording when discharging a sheet (P) to the sheet discharging/stacking part 40 is described.

In this case, a transfer process to transfer a toner image onto the intermediate transfer belt 10 is omitted, and the toner image formed on the photoreceptor l is directly transferred onto a sheet (P). When forming an image on one side of a sheet (P), a toner image on the photoreceptor 1 is a mirror image, which turns into a correct image when transferred onto the sheet (P).

In FIG. 1, a sheet (P) is conveyed between the photoreceptor 1 and the intermediate transfer belt 10 in synchronization with a toner image formed on the photoreceptor 1, and the toner image is transferred by the first transfer device 21 onto the sheet (P) (a upper surface of the sheet (P), i.e., a sheet surface opposing the photoreceptor 1) from the photoreceptor 1.

The second transfer device 22 is not operated, and the sheet (P) is moved together with the intermediate transfer belt 10, so that the toner image is fixed onto the sheet (P) by the fixing device 150. At this time, the fixing unit 50 is moved down, and the heating unit 54 is press-contacted against the fixing roller 18 via the intermediate transfer belt 10. Thereafter, the sheet (P) is separated from the intermediate transfer belt 10, and is then discharged in the direction indicated by the arrow A in FIG. 1, via the guide members 31*a* and 31*b* and the sheet discharging roller pair 34, so as to be stacked in the sheet discharging/stacking part 40 with the side of the sheet (P) carrying the images faced down. Thus, when images of multiple pages of an original document are processed in order of pages starting with the first page, the sheets P on which toner images of the images of the multiple pages of the original document are carried are in order of pages when the sheets P are taken out of the sheet discharging/stacking part 40. In this case, images are formed in the order of first page, second page, third page, fourth page, fifth page, sixth page, and so on.

Next, an operation for one side recording when discharging a sheet (P) to the sheet discharging tray 44 is described.

In this case, a toner image formed on the photoreceptor 1 is once transferred onto the intermediate transfer belt 10 by the action of the first transfer device 21. The intermediate transfer belt 10 carrying the transferred toner image is moved one cycle. At this time, the fixing unit 50 is moved upward and separated from the intermediate transfer belt 10. A sheet (P) is conveyed into between the photoreceptor 1 and the intermediate transfer belt 10 in synchronization with a toner image formed on the intermediate transfer belt 10, and the toner image is transferred by the second transfer device 22 onto the sheet (P) (a lower surface of the sheet (P), i.e., a sheet surface opposing the intermediate transfer belt 10) from the intermediate transfer belt 10. The sheet (P) is moved together with the intermediate transfer belt 10, so that the toner image is fixed onto the sheet (P) by the fixing unit 50, which is moved down, and the fixing roller 18. Thus, when images of multiple pages of an original document are processed in order of pages starting with the first page, the sheets P on which toner images of the images of the multiple pages of the original document are carried are in order of pages when the sheets P are taken out of the sheet discharging tray 44. In this case, images are formed in the order of first page, second page, third page, fourth page, fifth page, sixth page, and so on.

As described above, in the one side printing when the sheets P are discharged to the sheet discharging/stacking part 40 and the sheet discharging tray 44, although images are formed in the same order of first page, second page, third page, fourth page, and so on, a side of a sheet (P) onto which a toner image is transferred is different. Specifically, when discharging the sheet (P) to the sheet discharging/stacking part 40, the toner image is transferred from the photoreceptor 1 onto an upper sheet surface at the side of the photoreceptor 1. When discharging the sheet (P) to the sheet discharging tray 44, the toner image is transferred from the intermediate transfer belt 10 onto a lower sheet surface at the side of the intermediate transfer belt 10.

Next, another embodiment of the present invention in which a fixing device has a different construction is described.

Figure 3:
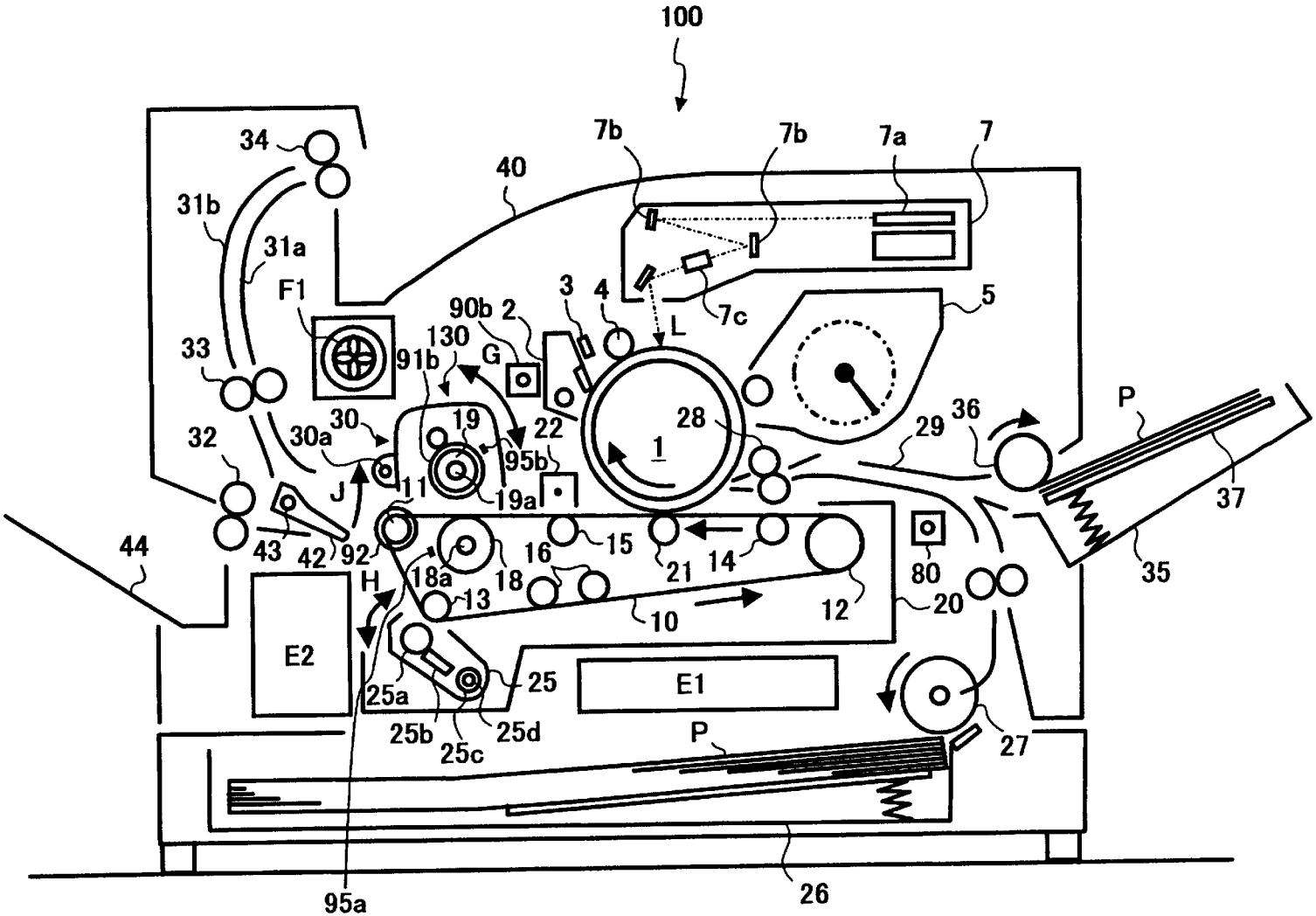
FIG. 3 is a cross sectional view of a printer according to another embodiment of the present invention.

The printer 100 illustrated in FIG. 3 includes a fixing device 130 of a heat roller type. The parts of the printer 100 other than the fixing device 130, and the image forming operation are substantially the same as in the printer 100 of FIG. 1, and therefore the description thereof will be omitted.

The fixing device 130 includes a fixing unit 30 and the fixing roller 18. The fixing unit 30 includes a fixing roller 19 having a heat source such as a heater (19*a*) inside thereof, and fixes a toner image, which has been transferred onto a second side of the sheet (P), onto the sheet (P). The fixing unit 30 is supported so as to be rotatable around a fulcrum (30*a*). The fixing unit 30 is rotated in a direction indicated by arrow (G) by a rotating device (not shown), so as to be pressed against the fixing roller 18 via the intermediate transfer belt 10 and a sheet, and to be separated from the fixing roller 18.

Figure 4:
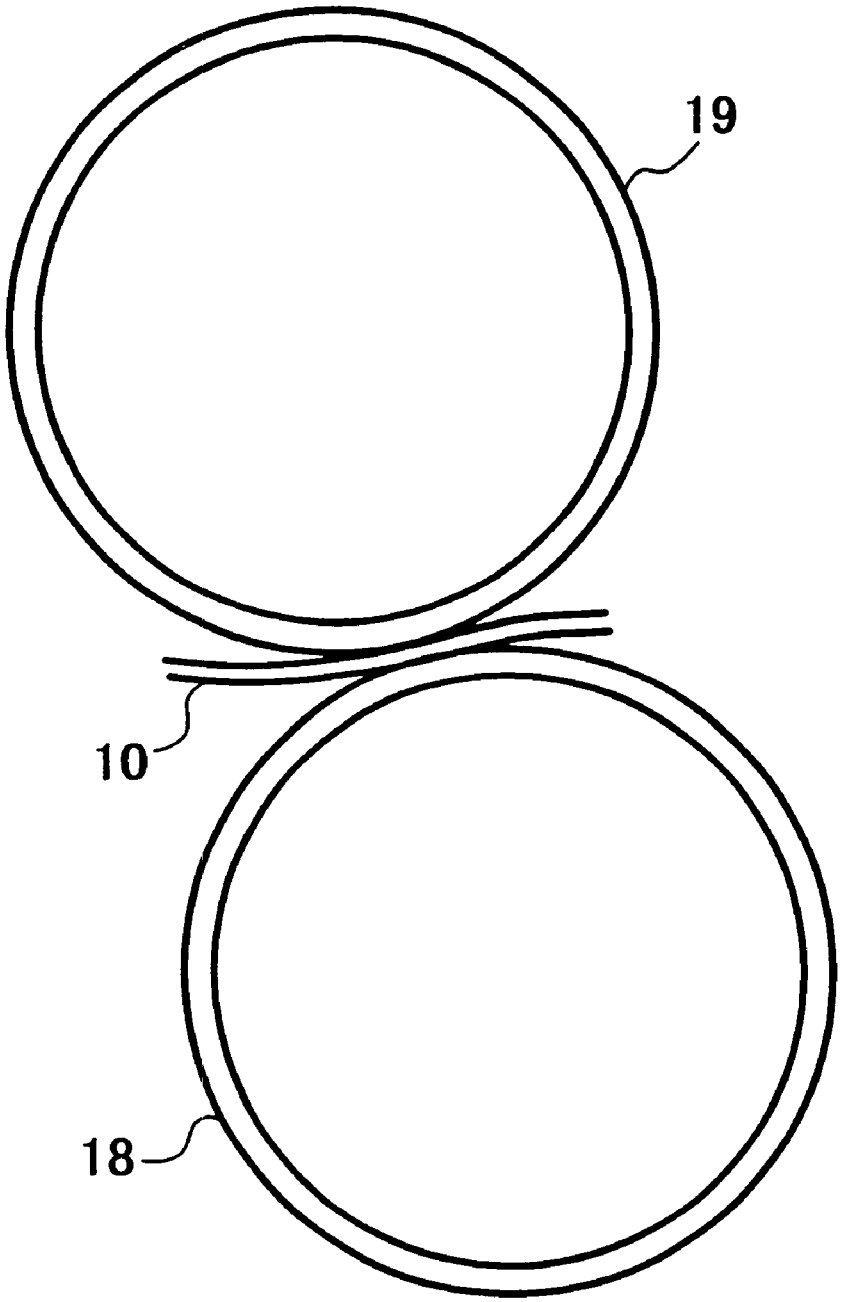
FIG. 4 is a schematic view of fixing rollers, and an intermediate transfer belt in a state that the fixing roller is press-contacted against the other fixing roller via the intermediate transfer belt in the printer illustrated in FIG. 3.

FIG. 4 illustrates the fixing rollers 18 and 19, and the intermediate transfer belt 10 in a state that the fixing roller 19 is press-contacted against the fixing roller 18 via the intermediate transfer belt 10. A sheet (P) having an unfixed toner image on one or both sides thereof is conveyed from the right to the left in FIG. 4 in close contact with the intermediate transfer belt 10, and passes through a fixing nip part formed between the fixing roller 19 and the fixing roller 18/the intermediate transfer belt 10.

In this embodiment, the fixing unit 30 is press-contacted against the fixing roller 18 via the intermediate transfer belt 10, and the sheet (P) passes between the fixing roller 19 and the intermediate transfer belt 10. Thus, the fixing roller 19 and the intermediate transfer belt 10 contact respective surfaces of the sheet (P) at a time of fixing a toner image thereon.

The fixing roller 19 is configured so that the surface property of the fixing roller 19 is substantially the same as that of the intermediate transfer belt 10. In this case, the fixing roller 19 serving as a heat roller includes a toner releasing coat layer made of fluorine resin on the surface thereof. In addition, by providing a toner releasing coat layer made of fluorine resin on the surface of the intermediate transfer belt 10, the surface properties of the fixing roller 19 and the intermediate transfer belt 10 are set to be substantially the same. As a result, image quality on both sides of the sheet (P) can be substantially equal.

Like the printer 100 of FIG. 1, surface roughness (Rz) of the intermediate transfer belt 10 and the fixing roller 19 is set to 100 $\mu$m or less. Thereby, excessive gloss and roughness of an image fixed on a sheet (P) are prevented.

Similarly as in the printer 100 of FIG. 1, a motor (90*b*) that drives the fixing roller 19 and the motor 80 that drives the drive roller 11 so as to rotate the intermediate transfer belt 10 are individually provided. The control device 200 in FIG. 7 controls the motors (90*b*) and 80 so that linear velocities of the fixing roller 19 and the intermediate transfer belt 10 are substantially the same. With the above-described control of the linear velocities of the fixing roller 19 and the intermediate transfer belt 10, image blurring is prevented, so that deterioration of image quality is obviated.

For example, the linear velocities of the fixing roller 19 and the intermediate transfer belt 10 are controlled to be substantially the same by use of encoders (91*b*) and 92 and the optical speed sensors 93 and 94. In this embodiment, as illustrated in FIGS. 3, 6A, and 6B, the encoders (91*b*) and 92 are provided on the respective rotation output shafts of the fixing roller 19 and the drive roller 11, respectively. Respective numbers of revolutions of the fixing roller 19 and the drive roller 11 are detected by the method of detecting slits on the circumferential surface of the rotation slit disks of the encoders (91*b*) and 92 with optical speed sensors 93 and 94, respectively.

The control device 200 controls the respective numbers of revolutions of the motors (90*b*) and 80 based on detection outputs of the optical speed sensors 93 and 94, respectively. With the use of the encoders (91*b*) and 92 and the optical speed sensors 93 and 94 functioning as a detecting device, the linear velocities of the fixing roller 19 and the intermediate transfer belt 10 can be controlled with accuracy.

In the fixing device 130 according to another embodiment of the present invention, as illustrated in FIG. 4, in a state that the fixing rollers 18 and 19 are press-contacted to each other via the intermediate transfer belt 10, the fixing rollers 18 and 19 are slightly shifted in the moving direction of the intermediate transfer belt 10 (i.e., in a substantially horizontal direction) and overlap each other in a direction perpendicular to the moving direction of the intermediate transfer belt 10 (i.e., in a substantially vertical direction). With the above-described arrangements of the fixing rollers 18 and 19 and the intermediate transfer belt 10, the fixing nip part between the fixing roller 19 and the fixing roller 18/intermediate transfer belt 10 is increased, so that fixing performance is increased also in the heat roller type fixing device 130.

The fixing rollers 18 and 19 include elastic layers covering metal cores, respectively. In addition, the surface layer on each of the elastic layers of the fixing rollers 18 and 19 is formed from a toner releasing coat layer made of fluorine resin. With provision of the elastic layers and toner releasing coat layers for the fixing rollers 18 and 19, the fixing nip part can be increased.

Similarly as in the printer 100 of FIG. 1, the control device 200 further controls respective temperatures of the heater (19*a*) of the fixing roller 19 and the heater (18*a*) of the fixing roller 18 arranged opposite to each other via the intermediate transfer belt 10. The respective temperatures of the heater (19*a*) and heater (18*a*) are detected by temperature sensors (95*b*) and (95*a*), respectively. The control device 200 individually controls supply of electricity to the heater (19*a*) and heater (18*a*) based on detection outputs of the temperature sensors (95*b*) and (95*a*), respectively.

In particular, for example, when both side recording, in which toner images are transferred onto both sides of a sheet (P) is selected, because the energy required for fixing the images is larger than when one side recording in which a toner image is transferred onto one side of the sheet (P) is selected, the printer 100 is controlled to increase the input voltage to the heat sources (i.e., the heater 19*a* and heater 18*a*) or increase the frequency of inputting the voltage into the heat sources.

Further, when fixing an image formed on one side of a sheet (P), the control device 200 controls to decrease or stop the supply of electricity to the heater 18(*a*) arranged inside of the loop of the intermediate transfer belt 10.

By individually controlling the respective temperatures of the heater (19*a*) of the fixing roller 19 arranged outside of the loop of the intermediate transfer belt 10 and the heater (18*a*) of the fixing roller 18 arranged inside of the loop, toner imager are surely fixed on both sides of the sheet (P) at the time of both side recording, and an excessive heat amount at the time of one side recording is avoided. As a result, an adequate fixing operation can be performed without wasting energy.

Some background image forming apparatuses separate a sheet, carrying unfixed toner images on both sides of the sheet, from a transfer belt to convey the sheet to a fixing device. Therefore, the toner images carried on both sides of the sheet tend to be disturbed when the sheet is being conveyed separated from the transfer belt or when the sheet abuts on the fixing device.

In the printer 100 according to the above-described embodiments of the present invention, because the fixing devices 50 and 30 and the fixing roller 18 fix toner images on the sheet (P) such that the sheet (P) is superimposed on the intermediate transfer belt 10, the toner images can be adequately fixed on the sheet (P) without shifting. As a result, deterioration of image quality is obviated.

In the printer 100 according to the above-described embodiments of the present invention, because the fixing operation is performed while a sheet is held on the intermediate transfer belt, good transfer, conveyance and fixing performance are realized without having image blurring, and thereby stable image quality can be obtained.

Next, another embodiment of the present invention in which the printer 100 includes a fixing device 60 arranged outside of the loop of the intermediate transfer belt 10 is described. The parts of the printer 100 other than the fixing device 60, and the image forming operation are substantially the same as in the printer 100 of FIGS. 1 and 3, and therefore the description thereof will be omitted.

Figure 5:
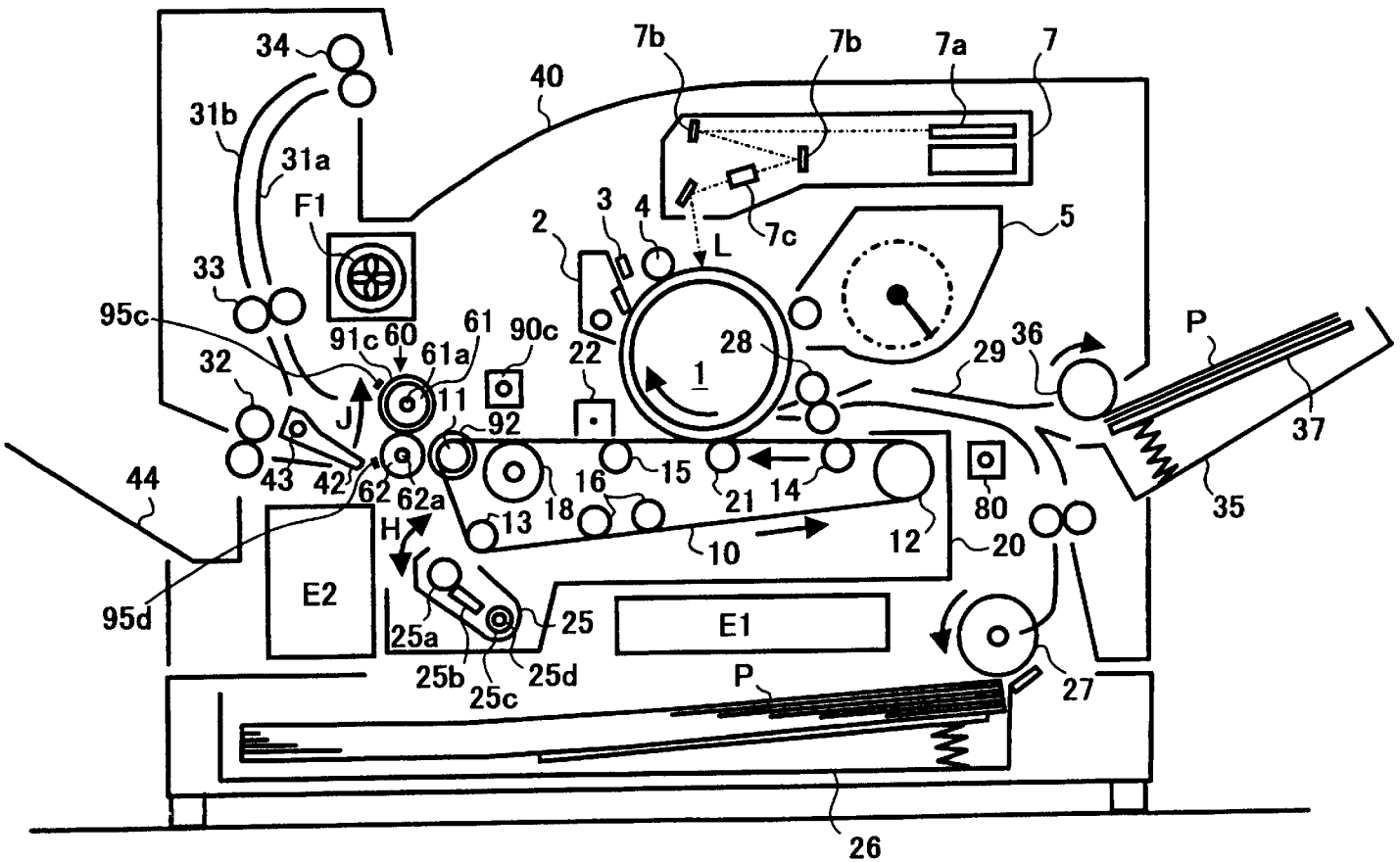
FIG. 5 is a cross sectional view of a printer according to another embodiment of the present invention.

The printer 100 illustrated in FIG. 5 includes the fixing device 60 of a heat roller type. The fixing device 60 includes a fixing roller 61 having a heat source such as a heater (61*a*) inside thereof, and a fixing roller 62 having a heat source such as a heater (62*a*) inside thereof. The fixing roller 62 is driven by the fixing roller 61.

The sheet (P) having an unfixed toner image is separated from the intermediate transfer belt 10 at a sheet separation part at the drive roller 11 by curvature of the intermediate transfer belt 10, and is conveyed to the fixing device 60. While the sheet (P) passes through a fixing nip part between the fixing rollers 61 and 62, the unfixed toner image is fixed on the sheet (P). In this embodiment, the fixing device 60 is arranged in a vicinity of the sheet separation part of the intermediate transfer belt 10.

In this embodiment, the sheet (P) passes through the fixing nip part between the fixing rollers 61 and 62. Thus, the fixing rollers 61 and 62 contact respective surfaces of the sheet (P) at a time of fixing a toner image thereon.

The fixing rollers 61 and 62 have substantially the same construction. Specifically, the fixing rollers 61 and 62 respectively include elastic layers made of silicone rubber or fluororubber, etc. covering metal cores. In addition, a surface layer on each of the elastic layers of the fixing rollers 61 and 62 is formed from a toner releasing coat layer made of fluorine resin. The hardness of the fixing rollers 61 and 62 is substantially the same, and is set in a range of about 25 Hs to 50 Hs (Japanese Industrial Standards). Because the fixing rollers 61 and 62 have substantially the same construction and are made of the same material, surface properties of the fixing rollers 61 and 62 are substantially the same, thereby causing the image quality on both sides of the sheet (P) to be substantially equal.

By setting the hardness of the fixing rollers 61 and 62 in a range of about 25 Hs to 50 Hs (Japanese Industrial Standards), stable fixing performance is surely obtained. If the hardness of the fixing rollers 61 and 62 is less than 25 Hs, the pressure exerted at the fixing nip part between the fixing rollers 61 and 62 may be low, so that the melting of toner may be inadequate. In this case, a fixing failure is likely to occur. If the hardness of the fixing rollers 61 and 62 is greater than 50 Hs, an enough width of the fixing nip part necessary for fixing a toner image on the sheet may not be acquired.

Further, surface roughness (Rz) of the fixing rollers 61 and 62 is set to 100 $\mu$m or less. Thereby, excessive gloss and roughness of an image fixed on a sheet are prevented.

In this embodiment, a motor (90*c*) that drives the fixing rollers 61 and 62 and the motor 80 that drives the drive roller 11 so as to rotate the intermediate transfer belt 10 are individually provided. The control device 200 in FIG. 7 controls the motors (90*c*) and 80 so that linear velocities of the fixing rollers 61, 62 and the intermediate transfer belt 10 are substantially the same. With the above-described control of the linear velocities of the fixing rollers 61/62 and the intermediate transfer belt 10, the sheet is smoothly fed to the fixing nip part between the fixing rollers 61 and 62 from the intermediate transfer belt 10. As a result, image blurring is prevented, so that deterioration of image quality is obviated.

For example, the linear velocities of the fixing rollers 61, 62 and the intermediate transfer belt 10 are controlled to be substantially the same by use of encoders (91*c*) and 92 and the optical speed sensors 93 and 94. In this embodiment, as illustrated in FIGS. 5, 6A, and 6B, the encoders (91*c*) and 92 are provided on the respective rotation output shafts of the fixing roller 61 and the drive roller 11, respectively. Respective numbers of revolutions of the fixing roller 61 and the drive roller 11 are detected by the method of detecting slits on the circumferential surface of the rotation slit disks of the encoders (91*c*) and 92 with optical speed sensors 93 and 94, respectively.

The control device 200 controls the respective numbers of revolutions of the motors (90*c*) and 80 based on detection outputs of the optical speed sensors 93 and 94, respectively. With the use of the encoders (91*c*), 92 and the optical speed sensors 93, 94 functioning as a detecting device, the linear velocities of the fixing rollers 61, 62 and the intermediate transfer belt 10 can be controlled with accuracy.

Similarly as in the printer 100 of FIG. 3, the control device 200 further controls respective temperatures of the heater (61*a*) of the fixing roller 61 and the heater (62*a*) of the fixing roller 62. The respective temperatures of the heater (61*a*) and heater (62*a*) are detected by temperature sensors (95*c*) and (95*d*), respectively. The control device 200 individually controls supply of electricity to the heater (61*a*) and heater (62*a*) based on detection outputs of the temperature sensors (95*c*) and (95*d*), respectively.

In particular, for example, when both side recording in which toner images are transferred onto both sides of a sheet (P) is selected, because the energy required for fixing the images is larger than when one side recording in which a toner image is transferred onto one side of the sheet (P) is selected, the printer 100 is controlled to increase the input voltage to the heat sources (i.e., the heater 61*a* and heater 62*a*) or increase the frequency of inputting the voltage into the heat sources.

Further, when fixing an image formed on one side of a sheet (P), the control device 200 controls to decrease or stop the supply of electricity to the heater (62*a*).

By individually controlling the respective temperatures of the heater (61*a*) of the fixing roller 61 and the heater (62*a*) of the fixing roller 62, toner images are surely fixed on both sides of the sheet (P) at the time of both side recording, and an excessive heat amount at the time of one side recording is avoided. As a result, an adequate fixing operation can be performed without wasting energy.

As described above, according to the embodiments of the present invention, the surface properties of the fixing belt 51 or the fixing roller 19 and the intermediate transfer belt 10 in contact with respective surfaces of a sheet (P) in the printer 100 of FIGS. 1 and 3 are substantially the same, and the surface properties of the fixing rollers 61 and 62 in contact with respective surfaces of the sheet (P) in the printer 100 of FIG. 5 are substantially the same. Therefore, image quality on both sides of the sheet (P) can be substantially equal, and high quality both side recording can be achieved.

The present invention has been described with respect to the embodiments illustrated in figure. However, the present invention is not limited to the embodiments and may be practiced otherwise.

Further, when recording images on both sides of a sheet, instead of turning one round the intermediate transfer belt 10 carrying thereupon a first side image, the intermediate transfer belt 10 can be rotated in the reverse direction to convey the first side image to a predetermined position. In this case, a mechanism is required to allow a first image bearing member (e.g., the photoreceptor 1) to separate from a second image bearing member (e.g., the intermediate transfer belt 10) even in an image forming apparatus configured to form an image only on one side of a sheet.

Furthermore, in the above embodiments, the first image bearing member is configured to be a photoconductor drum. However, the first image bearing member can be configured to be a belt.

Further, a charging device for a first image bearing member, a developing device, first and second transfer devices, and a fixing device can be constructed otherwise than as described in the above embodiments, and various other systems can be used.

The present invention has been described with respect to the printer 100 as an example of an image forming apparatus. However, it is needless to say that the present invention can be applied to other image forming apparatuses such as a copier or a facsimile machine.

The printer 100 in the above-described embodiments is not limited to a single color image forming apparatus, but may instead be a full color image forming apparatus.

The constructions of the above-described fixing belt type fixing device 150 and the heat roller type fixing devices 130 and 60 are just examples and not limited to the embodiments. For example, a fixing device can employ an induction heating method.

Although the drive motors (90*a*), (90*b*), (90*c*), and 80 are controlled by the same control device 200 as the heaters 56, (18*a*), (19*a*), (61*a*), and (62*a*) in the above-described embodiments, the drive motors and the heaters may be controlled by different control devices.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-292570 filed in the Japanese Patent Office on Sep. 26, 2000, and Japanese Patent Application No. 2001-270235 filed in the Japanese Patent Office on Sep. 6, 2001, and the entire contents of each of which are hereby incorporated herein by reference.

What is claimed as new and is desired to be secured by Letters Patent of the United States is:

1. An image forming apparatus, comprising:

a first image bearing member configured to bear first and second visual images;

a second image bearing member configured to bear the first visual image transferred from the first image bearing member;

a recording medium with first and second sides;

a first transfer device configured to transfer the first visual image formed on the first image bearing member onto the second image bearing member or the second visual image formed on the first image bearing member onto a second side of the recording medium;

a second transfer device configured to transfer the first visual image carried by the second image bearing member onto the first side of the recording medium; and a fixing device configured to fix the first and second visual images transferred onto the recording medium, the fixing device including first and second fixing members configured to fix the second and first visual images on the second and first sides of the recording medium, respectively, wherein the first fixing member and the second image bearing member contact the second and first sides of the recording medium, respectively, and wherein surface properties of the first fixing member and the second image bearing member are substantially the same.

2. The image forming apparatus according to claim 1, wherein the first fixing member and the second image bearing member are formed from material of the same kind.

3. The image forming apparatus according to claim 2, wherein the first fixing member and the second image bearing member are formed from the same material.

4. The image forming apparatus according to claim 1, wherein the first fixing member and the second image bearing member are substantially the same by providing coat layers having the same surface properties on respective surfaces of the first fixing member and the second image bearing member.

5. The image forming apparatus according to claim 1, wherein the fixing device comprises a belt type fixing device, and wherein the first fixing member of the fixing device is a fixing belt.

6. The image forming apparatus according to claim 5, wherein a thickness of the fixing belt is 200 $\mu$m or less.

7. The image forming apparatus according to claim 5, wherein the fixing belt is formed from a heat-resisting resin film.

8. The image forming apparatus according to claim 1, wherein the fixing device is a heat roller type fixing device, and wherein the first and second fixing members of the fixing device are shaped in a form of fixing rollers, respectively.

9. The image forming apparatus according to claim 8, wherein the fixing rollers include elastic layers, respectively.

10. The image forming apparatus according to claim 8, wherein the second image bearing member is shaped in a form of an endless belt, and wherein the fixing rollers are arranged opposite to each other via the endless-belt-like shaped second image bearing member such that the fixing rollers are shifted with respect to each other in a moving direction of the endless-belt-like shaped second image bearing member and are overlapped with each other in a direction perpendicular to the moving direction of the endless-belt-like shaped second image bearing member.

11. The image forming apparatus according to claim 1, wherein the surface properties of the first fixing member and the second image bearing member are surface roughness (Rz).

12. The image forming apparatus according to claim 11, wherein the surface roughness (Rz) of the first fixing member and the second image bearing member is 100 $\mu$m or less.

13. The image forming apparatus according to claim 1, further comprising a control device configured to control a temperature of at least one of the first and second fixing members to change when obtaining one of the first and second visual images on the first and second sides of the recording medium from when obtaining both of the first and second visual images.

14. The image forming apparatus according to claim 1, further comprising a control device configured to control an operation of the apparatus, wherein the second image bearing member comprises an endless belt, and the first and second fixing members include heat elements arranged inside and outside of a loop of the endless-belt-like shaped second image bearing member, respectively, and the control device individually controls respective temperatures of the heat elements of the first and second fixing members.

15. The image forming apparatus according to claim 1, further comprising motors configured to drive the first fixing member and the second image bearing member, respectively, and a control device configured to control each motor such that linear velocities of the first fixing member and the second image bearing member are substantially the same.

16. The image forming apparatus according to claim 15, further comprising:

a detecting device configured to detect respective linear velocities of the first fixing member and the second image bearing member, wherein the control device controls each motor based on a detect output of the detecting device.

17. The image forming apparatus according to claim 1, wherein the fixing device fixes the first and second visual images on the first and second sides of the recording medium in a state that the second image bearing member and the recording medium are overlapped with each other.

18. An image forming apparatus, comprising:

a first image bearing member configured to bear first and second visual images;

a second image bearing member configured to bear the first visual image transferred from the first image bearing member;

a recording medium with first and second sides;

a first transfer device configured to transfer the first visual image formed on the first image bearing member onto the second image bearing member or the second visual image formed on the first image bearing member onto the second side of the recording medium;

a second transfer device configured to transfer the first visual image carried by the second image bearing member onto the first side of the recording medium; and a fixing device configured to fix the first and second visual images transferred onto the recording medium, the fixing device including first and second fixing members configured to fix the second and first visual images on the second and first sides of the recording medium, respectively, wherein the first and second fixing members contact the second and first sides of the recording medium, respectively, wherein surface properties of the first and second fixing members are substantially the same, wherein the second image bearing member is shaped to form an endless belt, and wherein the surface properties of the first fixing member and the second image bearing member are surface roughness (Rz).

19. The image forming apparatus according to claim 18, wherein the surface roughness of the first and second fixing members is 100 $\mu$m or less.

20. An image forming apparatus, comprising:

a first image bearing member configured to bear first and second visual images;

a second image bearing member configured to bear the first visual image transferred from the first image bearing member;

a recording medium with first and second sides;

a first transfer device configured to transfer the first visual image formed on the first image bearing member onto the second image bearing member or the second visual image formed on the first image bearing member onto the second side of the recording medium;

a second transfer device configured to transfer the first visual image carried by the second image bearing member onto the first side of the recording medium; and a fixing device configured to fix the first and second visual images transferred onto the recording medium, the fixing device including first and second fixing members configured to fix the second and first visual images on the second and first sides of the recording medium, respectively, wherein the first and second fixing members contact the second and first sides of the recording medium, respectively, wherein surface properties of the first and second fixing members are substantially the same, wherein the second image bearing member is shaped to form an endless belt, and wherein the surface properties of the first and second fixing members are hardness.

21. The image forming apparatus according to claim 20, wherein the hardness of the first and second fixing members is in a range of about 25 Hs to 50 Hs.

22. A method of forming an image, comprising the steps of:

transferring a first visual image formed on a first image bearing member onto a second image bearing member;

transferring a second visual image formed on the first image bearing member onto a second side of a recording medium;

transferring the first visual image from the second image bearing member onto a first side of the recording medium;

bringing a first fixing member and the second image bearing member into contact with the second and first sides of the recording medium, respectively; and fixing the first and second visual images on the first and second sides of the recording medium in a state that surface properties of the first fixing member and the second image bearing member are substantially the same.

23. The method according to claim 22, further comprising changing a temperature of at least one of the first fixing member and a second fixing member when obtaining one of the first and second visual images on the first and second sides of the recording medium from the temperature of one of the first fixing member and the second fixing member when obtaining both of the first and second visual images.

24. The method according to claim 22, wherein the second image bearing member is shaped in a form of an endless belt, and the first fixing member and the second fixing member include heat elements are arranged inside and outside of a loop of the endless-belt-like shaped second image bearing member, respectively, and wherein the method further comprises:

controlling respective temperatures of the heat elements of the first and second fixing members individually.

25. The method according to claim 22, further comprising:

controlling motors that drive the first fixing member and the second image bearing member, respectively, such that linear velocities of the first fixing member and the second image bearing member are substantially the same.

26. The method according to claim 25, wherein the step of controlling the motors includes controlling each motor based on a detection output of a detecting device.

27. The method according to claim 22, wherein the step of fixing the first and second visual images comprises:

fixing the first and second visual images on the first and second sides of the recording medium in a state that the second image bearing member and the recording medium are overlapped with each other.

28. An image forming apparatus which may form first and second visual images on first and second sides of a recording medium, comprising:

first image bearing means for bearing the first and second visual images;

second image bearing means for bearing the first visual image transferred from the first image bearing means;

a recording medium with first and second sides;

first transferring means for transferring the first visual image formed on the first image bearing means onto the second image bearing means or the second visual image formed on the first image bearing means onto the second side of the recording medium;

second transferring means for transferring the first visual image carried by the second image bearing means onto the first side of the recording medium; and fixing means for fixing the first and second visual images transferred onto the recording medium, the fixing means including first and second fixing means for fixing the second and first visual images on the second and first sides of the recording medium, respectively, wherein the first fixing means and the second image bearing means contact the second and first sides of the recording medium, respectively, and wherein surface properties of the first fixing means and the second image bearing means are substantially the same.

29. The image forming apparatus according to claim 28, further comprising control means for controlling a temperature of at least one of the first and second fixing means to change when obtaining one of the first and second visual images on the first and second sides of the recording medium from when obtaining both of the first and second visual images.

30. The image forming apparatus according to claim 28, further comprising:

control means for controlling an operation of the apparatus, wherein the second image bearing means is shaped in a form of an endless belt, and the first and second fixing means include heat elements arranged inside and outside of a loop of the endless-belt-like shaped second image bearing means, respectively, and wherein the control means individually controls respective temperatures of the heat elements of the first and second fixing means.

31. The image forming apparatus according to claim 28, further comprising:

means for driving the first fixing means and the second image bearing means, respectively, and control means for controlling each driving means such that linear velocities of the first fixing means and the second image bearing means are substantially the same.

32. The image forming apparatus according to claim 31, further comprising detecting means for detecting respective linear velocities of the first fixing means and the second image bearing means, wherein the control means controls each driving means based on a detect output of the detecting means.

* * * * *